US012337252B2

(12) United States Patent
Salvino

(10) Patent No.: US 12,337,252 B2
(45) **Date of Patent: *Jun. 24, 2025**

(54) BALLOON CONTAINMENT DEVICE

(71) Applicant: Nevin R. Salvino, Wauconda, IL (US)

(72) Inventor: Nevin R. Salvino, Wauconda, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/541,872

(22) Filed: Dec. 15, 2023

(65) Prior Publication Data

US 2024/0139639 A1 May 2, 2024

Related U.S. Application Data

(63) Continuation of application No. 16/418,948, filed on May 21, 2019, now Pat. No. 11,878,256.

(51) Int. Cl.
*A63H 27/10* (2006.01)

(52) U.S. Cl.
CPC ..... *A63H 27/10* (2013.01); *A63H 2027/1041* (2013.01); *A63H 2027/1091* (2013.01)

(58) Field of Classification Search
CPC ..... A63H 27/10; A63H 2027/1041; A63H 2027/1083
See application file for complete search history.

(56) References Cited

U.S. PATENT DOCUMENTS 1,211,369 A 1/1917 Miller
1,245,444 A * 11/1917 Creque ..... A63H 27/10 446/224
1,283,095 A 10/1918 Cummisky
1,814,055 A * 7/1931 Napier ..... A63H 27/10 446/177
2,197,617 A * 4/1940 Magran ..... A63H 27/10 383/3
2,210,024 A 8/1940 Cayo
2,449,147 A 9/1948 Samuels
2,542,361 A * 2/1951 Roxburgh ..... A63H 27/10 439/271
2,617,624 A 11/1952 Annis
(Continued)

FOREIGN PATENT DOCUMENTS

DE 102017125161 B3 * 1/2019
GB 2363634 A 1/2002

OTHER PUBLICATIONS

Translation DE102017125161B3 (Year: 2019).*
U.S. Appl. No. 16/135,857, filed Sep. 19, 2018, Salvino.

*Primary Examiner* — Eugene L Kim
*Assistant Examiner* — Alyssa M Hylinski
(74) *Attorney, Agent, or Firm* — Crowell & Moring LLP

(57) ABSTRACT

The present invention provides a balloon containment device comprising a central portion having a diameter larger than the diameter of the narrowest part of an expanded opening portion of a balloon. An elongate external retainer extends from the central portion toward a proximate end to the balloon opening portion and having a length enabled for placement of the central portion, extending through a neck portion of the balloon opening portion. An elongate internal retainer extends from the central portion, and toward a distal end from the balloon opening portion, and having a length designed for placement inside of the balloon. Wherein when the balloon is inflated, the central portion is held against the neck portion by manipulation of the external retainer.

20 Claims, 14 Drawing Sheets

(56) References Cited

U.S. PATENT DOCUMENTS

| | | | | | |
|---|---|---|---|---|---|
| 2,663,968 | A | | 12/1953 | Longino | |
| 2,693,191 | A | | 11/1954 | Raiche | |
| 2,924,041 | A | | 2/1960 | Jackson et al. | |
| 2,936,760 | A | | 5/1960 | Gants | |
| 2,960,994 | A | * | 11/1960 | Shaffer | F16K 15/202 137/533 |
| 3,401,714 | A | | 9/1968 | Scott | |
| 3,616,569 | A | | 11/1971 | Litt et al. | |
| 4,019,515 | A | | 4/1977 | Kornblum et al. | |
| 4,701,148 | A | | 10/1987 | Cotey | |
| 4,873,976 | A | | 10/1989 | Schreiber | |
| 4,911,674 | A | | 3/1990 | Cole | |
| 5,282,768 | A | * | 2/1994 | Akman | A63H 27/10 446/221 |
| 5,312,343 | A | | 5/1994 | Krog et al. | |
| 5,496,203 | A | | 3/1996 | Murray | |
| 5,944,576 | A | * | 8/1999 | Nelson | A63H 27/10 446/222 |
| 6,602,105 | B1 | * | 8/2003 | Sussell | A63H 27/10 362/253 |
| 6,814,644 | B2 | * | 11/2004 | Nelson | A63H 27/10 446/224 |
| D576,254 | S | | 9/2008 | McBroom | |
| 8,512,091 | B2 | | 8/2013 | Nelson et al. | |
| 9,192,872 | B2 | | 11/2015 | Hakam et al. | |
| 11,878,256 | B2 | * | 1/2024 | Salvino | A63H 27/10 |
| 2006/0291217 | A1 | * | 12/2006 | Vanderschuit | A63H 33/22 362/363 |
| 2008/0032588 | A1 | | 2/2008 | Sun | |
| 2010/0246165 | A1 | * | 9/2010 | Diaz | A63H 33/22 362/183 |
| 2012/0148765 | A1 | | 6/2012 | Halliburton | |
| 2012/0296272 | A1 | | 11/2012 | Bidault et al. | |
| 2014/0212074 | A1 | * | 7/2014 | Durst | A63H 27/10 383/44 |
| 2017/0319976 | A1 | * | 11/2017 | Nelson | A63H 27/10 |

* cited by examiner

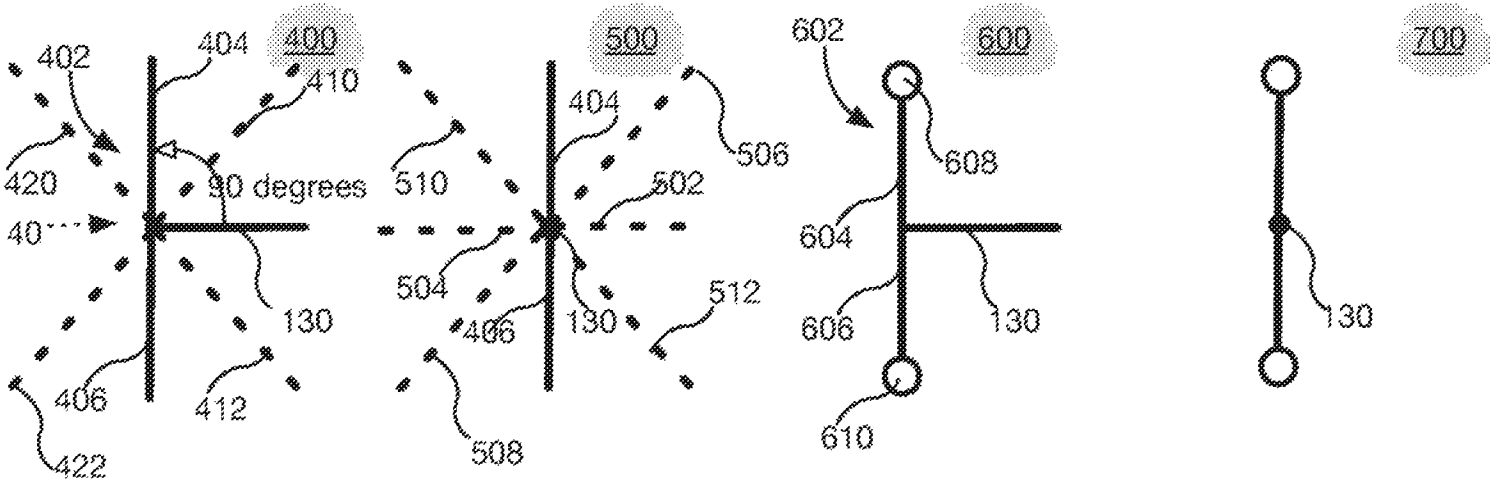
FIG. 4
FIG. 5
FIG. 6
FIG. 7
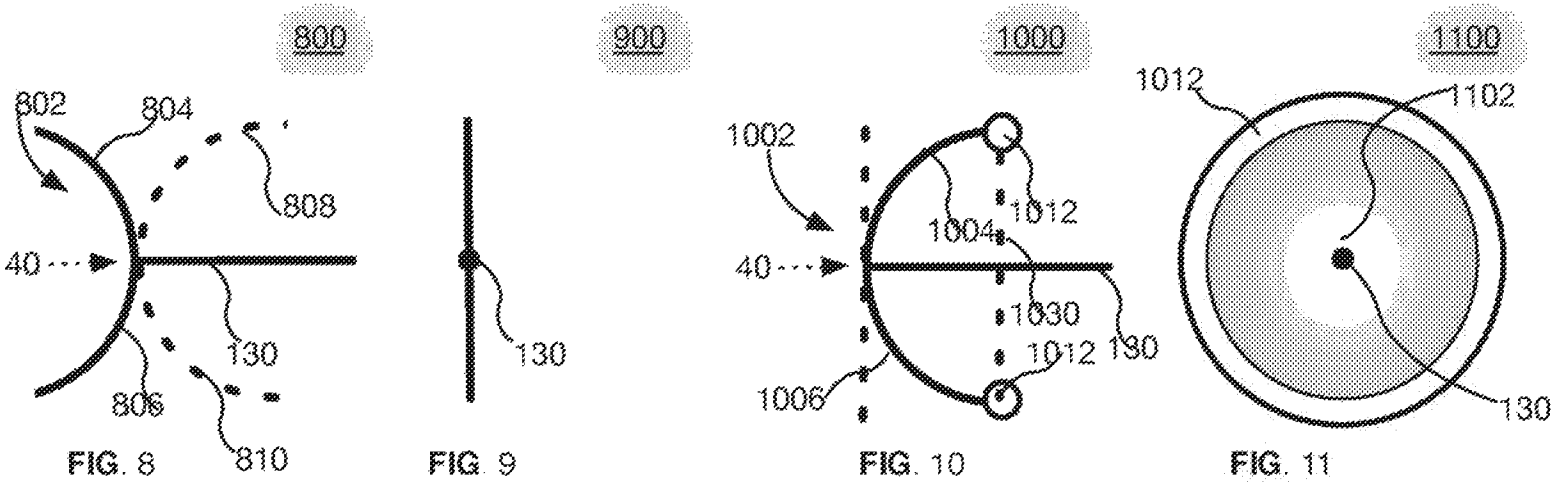
FIG. 8
FIG. 9
FIG. 10
FIG. 11

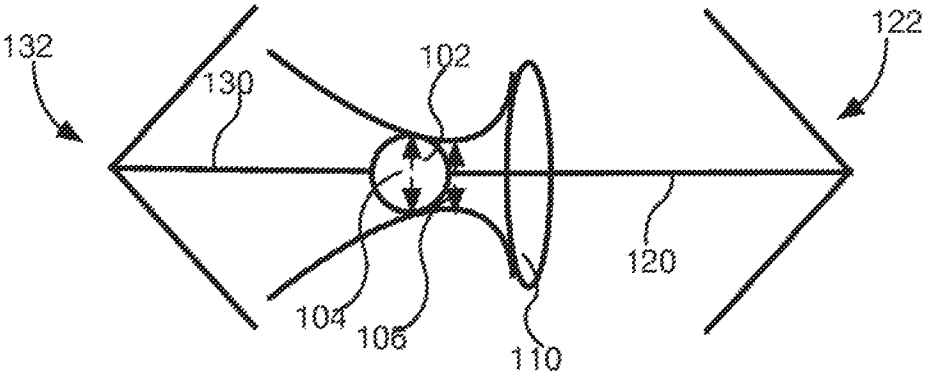
FIG. 12
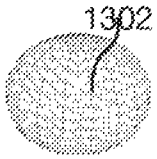
FIG. 13
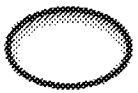
FIG. 14
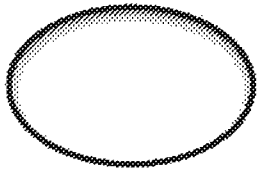
FIG. 15
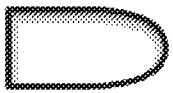
FIG. 16
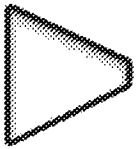
FIG. 17
FIG. 18
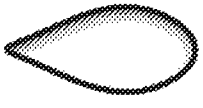
FIG. 19
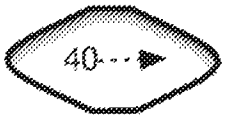
FIG. 20
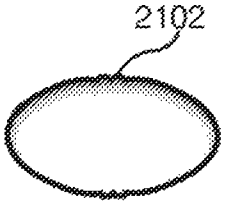
FIG. 21
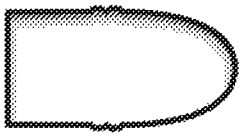
FIG. 22

BALLOON CONTAINMENT DEVICE

RELATED APPLICATIONS

This application is a continuation of U.S. application Ser. No. 16/418,948, filed on May 21, 2019, pending, the entirety of which is herein incorporated by reference.

BACKGROUND

1. Technical Field

The present disclosure relates generally to a balloon tie, more specifically, to a balloon air containment device.

2. Background Information

Balloons are used for many purposes including entertainment, promotion, or some practical purposes, such as meteorology, medical treatment, military defense, or transportation. Balloons can be filled with a gas or a liquid. The conventional method of containing the gas or liquid inside the balloon is to have a user tie the end of the balloon into a knot.

In certain circumstances tying the end of the balloon into a knot can be cumbersome or ineffectual. There is a need for a device which contains air or liquid inside a balloon without having to tie the end of the balloon.

SUMMARY OF THE INVENTION

While the following describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed.

Where means-plus-function clauses are used in the claims such language is intended to cover the structures described herein as performing the recited functions and not only structural equivalents but equivalent structures as well. For the purposes of the present disclosure, two structures that perform the same function within an environment described above may be equivalent structures.

Disclosed herein is a balloon containment device including a central portion having a diameter larger than the diameter of the narrowest part of an expanded opening portion of a balloon. The device includes a longitudinally extending first portion extending from the central portion toward a proximate end to the balloon opening portion and having a length designed for placement extending outside the balloon opening portion. The device includes a longitudinally extending second portion extending from the central portion, and toward a distal end from the balloon opening portion, and having a length designed for placement inside of the balloon.

Disclosed herein is a balloon containment device including a means for plugging a balloon, a means for maintaining a portion of the device outside the balloon, and a means for maintaining a portion of the device inside of the balloon.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of some of those embodiments.

The apparatus and components have been represented where appropriate by conventional symbols in the drawings, showing specific details that are pertinent to understanding the embodiments of the disclosure herein so as not to obscure the disclosure with details that will be readily apparent to those of ordinary skill in the art having the benefit of the description herein.

FIG. 4 illustrates a longitudinal cross sectional view of embodiments of an internal end portion.

FIG. 5 illustrates a lateral cross sectional view of embodiments of an internal end portion.

FIG. 6 illustrates a longitudinal cross sectional view of embodiments of an internal end portion.

FIG. 7 illustrates a lateral cross sectional view of embodiments of an internal end portion.

FIG. 8 illustrates a longitudinal cross sectional view of embodiments of an internal end portion.

FIG. 9 illustrates a lateral cross sectional view of embodiments of an internal end portion.

FIG. 10 illustrates a longitudinal cross sectional view of embodiments of an internal end portion.

FIG. 11 illustrates a lateral cross sectional view of embodiments of an internal end portion.

FIG. 12 illustrates a close-up view of the embodiment of the balloon containment device including an embodiment of means for plugging a balloon.

FIGS. 13-22 illustrate longitudinal cross sectional view of different embodiments of a means for plugging a balloon.

DETAILED DESCRIPTION OF THE PREFERRED EMBODIMENTS

A balloon is a flexible bag that can be inflated with a gas, such as helium, hydrogen, nitrous oxide, oxygen, air, or water. A balloon can be made from a material including any one or more of the following: rubber, latex, polychloroprene, or a nylon fabric, or any conventional material known in the art at the time of filing this disclosure. The conventional method of keeping the gas or liquid in the balloon is to tie the end of the balloon into a knot. The conventional method of tying a knot can be ineffectual and cumbersome in some cases. There is a need for a device which contains contents of a balloon without having to tie the end of the balloon.

Disclosed herein is an embodiment of a method and device for taking a deflated blow up balloon, and putting a ball like shape inside the deflated balloon. The balloon can be blown up to a desired size. A ball shaped material can be placed at the blowhole of the balloon so air pressure clogs the ball into the blowhole keeping the balloon inflated without needing to tie the balloon to keep it inflated. The device can unclog the ball to let air out of balloon to be able to more easily reuse the balloon. The ball like piece can be made of a light material or substance and can vary in size to accommodate a different size balloon or a balloon with different elastic property.

A means for plugging a balloon can include a ball like material piece, which can be hard or soft, and can have a tacky or smooth surface. In an embodiment, it can have a non tacky smooth ball like round surface. In an embodiment, it can have a portion or all of its surface be a sticky surface.

Exact dimensions and embodiments of the balloon containment device can vary and can be determined based upon properties of an existing balloon known by one having ordinary skill in the art at the time of the invention, having the benefit of the description herein. In an embodiment, the ball valve for the balloon containment device has attached a string lanyard.

The string lanyard can be attached to the ball. After the balloon is inflated, the string can be used for holding the balloon, without the effort of tying a knot on the balloon stem. In an embodiment, a balloon containment device includes a round ball to keep the balloon inflated without needing to tie balloon by hand, making it much faster and easier to contain the contents of the balloon.

Figure 1:
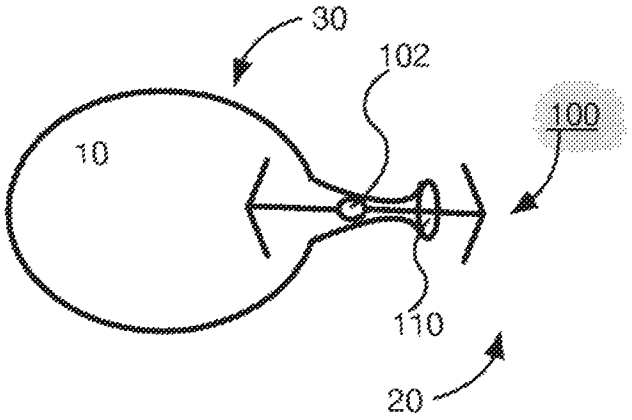
FIG. 1 illustrates a longitudinal cross sectional view of an embodiment of a balloon containment device as it is placed inside a balloon.
Figure 2:
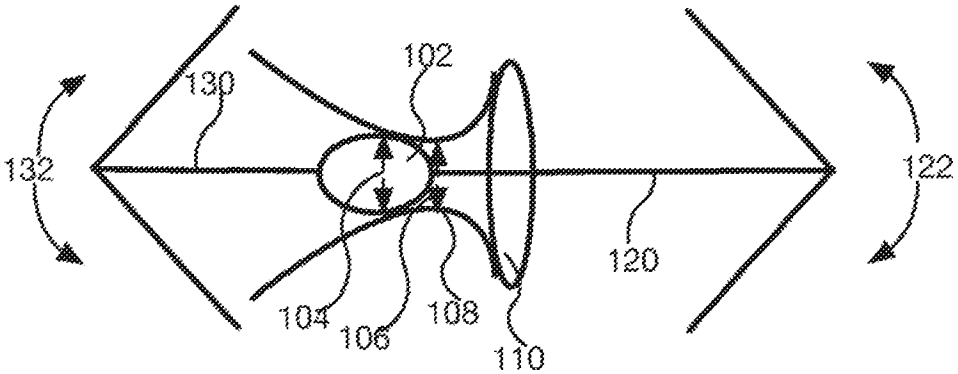
FIG. 2 illustrates a close-up view of the embodiment of the balloon containment device in FIG. 1.

FIG. 1 illustrates a longitudinal cross sectional view of an embodiment of a balloon containment device 100 as it is placed inside a balloon 10. FIG. 2 illustrates a close-up view of the embodiment of the balloon containment device 100 in FIG. 1. In an embodiment, a balloon containment device 100 comprises a central portion 102 having a diameter 104 larger than the diameter 106 of the narrowest part 108 of an expanded opening portion 110 of a balloon 10. A longitudinally extending first portion 120 extends from the central portion 102 toward a proximate end 20 to the balloon opening portion 110. It is proximate in relation to the balloon opening portion 110. The longitudinally extending first portion 120 has a length designed for placement extending outside the balloon opening portion 110. Depending upon the different balloon, the length can be customized to extend from the central portion 102 past the balloon opening portion 110 and to have extra length to be able to be handled easily by a user to insert, remove, or hold the balloon or place the balloon where it is desired. The device 100 includes a longitudinally extending second portion 130 extending from the central portion 102, and toward a distal end 30 from the balloon opening portion 110, and having a length customized for placement inside of the balloon 10.

In an embodiment, the balloon containment device 100 can have a longitudinally extending first portion 120 include an external retainer end 122 for partial retainment of the device 100 to partially stay outside the balloon 10. In an embodiment, the balloon containment device 100 can have a longitudinally extending second portion 130 include an internal retainer end 132 for partial retainment of the device 100 to partially stay inside the balloon 10. In an embodiment, the external retainer end 122 and the internal retainer end 132 each have the same shape.

Figure 3:
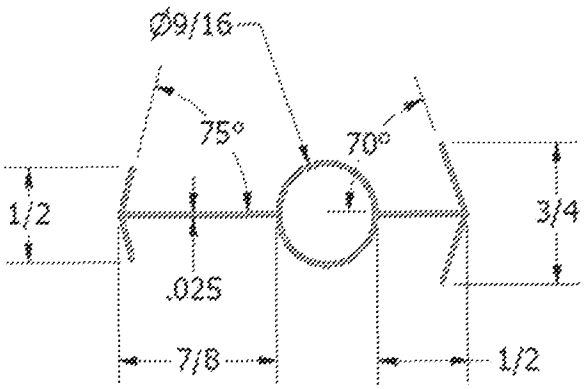
FIG. 3 illustrates an embodiment of a balloon containment device with example dimensions.

FIG. 3 illustrates an embodiment of a balloon containment device 100 with example dimensions. For example, the central portion 102 can be a sphere with a diameter of 9/16 of an inch. The longitudinally extending first portion 120 can be 1;2 inches in length. The external retainer end 122 can have an angled upper portion angled 70 degrees from the longitudinal axis with 0 degrees being the direction toward the central portion 102. It can also have an angled lower portion angled 290 degrees from the longitudinal axis with 0 degrees being the direction toward the central portion 102. The length of the retainer end portion can be % of an inch. It can have the longitudinally extending second portion 130 have a length of 7/8 inches. Its internal retainer end 132 can include an angled upper portion angled 75 degrees from the longitudinal axis with 0 degrees being the direction toward the central portion 102. It can also have an angled lower portion angled 285 degrees from the longitudinal axis with 0 degrees being the direction toward the central portion 102. The length of the retainer end portion 132 can be ½ of an inch. The thickness of each of the longitudinally extending first portion 120, the longitudinally extending second portion 130, the external retainer end 122, the internal retainer end 132 can be 0.025 inches. Different dimensions can be understood given the particular balloon and given the benefit of this disclosure and the functions performed of the device and methods described herein.

In an embodiment, the central portion 102 or a means for plugging a balloon can be made of a hard substance, such as metal or plastic. In an embodiment, the central portion 102 or a means for plugging a balloon can be made of a soft material, such as foam or contained air.

The balloon containment device can work with different embodiments of an external retainer end 122 and different embodiments of an internal retainer end 132. Each of these ends can be the same or similar or different using any combination of the ends described herein. For example, FIG. 3 illustrates similarly shaped ends of different dimensions. Throughout the disclosure one end can be exchanged with the other. For example, the internal retainer end 132 illustrated in FIG. 3 can be the external retainer end 122 and vice versa or both ends can have the same shape and dimensions.

Each of the internal retainer end 132 and the external retainer end 122 can be further described with differences. For example, FIG. 4 illustrates a longitudinal cross sectional view 400 of embodiments of a portion of an internal retainer end 132. A first embodiment is identified with a solid line in FIG. 4. Subsequent embodiments are illustrated with dashed lines to more easily show them as alternatives.

In an embodiment illustrated with the solid line in FIG. 4, the internal retainer end 132 includes an internal end portion 402 having an upper portion 404 extending above a single plane containing the longitudinal axis 40 of the device 100, and a lower portion 406 extending below the single plane containing the longitudinal axis 40 of the device 100. In this embodiment, the upper end portion 404 extends along about a 90 degree angle away from the single plane, and the lower end portion extends along about a 270 degree angle away from the single plane.

In an alternative embodiment, internal end portion 402 includes an upper portion 410 and a lower end portion 412, each with ends angled toward the central portion 102. In an alternative embodiment, internal end portion 400 includes an upper portion 420 and a lower end portion 422, each with ends angled away from the central portion 102.

FIG. 5 illustrates a lateral cross sectional view 500 of embodiments of the internal end portions illustrated in FIG. 4. Each of the embodiments illustrated in FIG. 4 would have the lateral cross sectional view of upper portion 404 and lower portion 406 as any variation in angle in the longitudinal plane would appear similar in the lateral cross section, as illustrated by the solid line. In an alternative embodiment, the internal end portion 402 is illustrated by the dashed lines. In an embodiment, internal end portion 402 can include additional portions additional to the upper portion 404 and lower portion 406. For example, internal end portion 402 can include upper portion 404, lower portion 406, right lateral portion 502, and left lateral portion 504. In an embodiment, internal end portion 402 can include upper portion 404, lower portion 406, right lateral portion 502, and left lateral portion 504, and one or more additional end portions, such as portion 506, portion 508, portion 510, portion 512. In an embodiment, internal end portion 402 can include a continuous portion having a surface area in a lateral plane crossing the longitudinal axis of the device 100.

FIG. 6 illustrates a longitudinal cross sectional view 600 of embodiments of an internal end portion 602. In an embodiment, internal end portion 602 includes an upper portion 604 and lower portion 606, each portion having a spherical structure 608, 610 attached to its respective end. FIG. 7 illustrates a lateral cross sectional view 700 of embodiments of an internal end portion 602.

FIG. 8 illustrates a longitudinal cross sectional view 800 of embodiments of an internal end portion 802. In an embodiment, the longitudinally extending second portion 130 includes an internal retainer end 132 for partial retainment of the device 100 to partially stay inside the balloon 10. In an embodiment, internal retainer end 132 includes internal end portion 802 having an upper end portion 804 and a lower end portion 806. In an embodiment, upper portion 804 extends above a single plane containing the longitudinal axis 40 of the device 100, and a lower portion 806 extends below the single plane containing the longitudinal axis 40 of the device 100. In an embodiment, upper end portion 804 starts to extend along about a 90 degree angle away from the single plane, and the lower end portion 806 starts to extend along about a 270 degree angle away from the single plane. In an embodiment, upper end portion 804 continues to extend by having a curved form curving away from longitudinally extending second portion 130, and the lower portion 806 continues to extend by having a curved form curving away from the longitudinally extending second portion 130.

FIG. 8 illustrates with the dashed line an alternative embodiment of internal end portion 802. In an embodiment, internal end portion 802 having an upper end portion 808 and a lower end portion 810. In an embodiment, upper portion 808 extends above a single plane containing the longitudinal axis 40 of the device 100, and a lower portion 810 extends below the single plane containing the longitudinal axis 40 of the device 100. In an embodiment, upper end portion 808 starts to extend along about a 90 degree angle away from the single plane, and the lower end portion 810 starts to extend along about a 270 degree angle away from the single plane. In an embodiment, upper end portion 808 continues to extend by having a curved form curving toward longitudinally extending second portion 130, and the lower portion 810 continues to extend by having a curved form curving toward the longitudinally extending second portion 130. FIG. 9 illustrates a lateral cross sectional view 900 of embodiments of an internal end portion 802.

FIG. 10 illustrates a longitudinal cross sectional view 1000 of embodiments of an internal end portion 1002. The dashed line on FIG. 10 shows an embodiment similar to the embodiment of the internal end portion 402 illustrated in FIG. 4. In an embodiment, internal end portion 1002 having an upper end portion 1004 and a lower end portion 1006. In an embodiment, upper portion 1004 extends above a single plane containing the longitudinal axis 40 of the device 100, and a lower portion 1006 extends below the single plane containing the longitudinal axis 40 of the device 100. In an embodiment, upper end portion 1004 starts to extend along about a 90 degree angle away from the single plane, and the lower end portion 1006 starts to extend along about a 270 degree angle away from the single plane. In an embodiment, upper end portion 1004 continues to extend by having a curved form curving toward longitudinally extending second portion 130, and the lower portion 1006 continues to extend by having a curved form curving toward the longitudinally extending second portion 130. In an embodiment, upper end portion 1004 and the lower end portion 1006 attach to a toric joint 1012 or a ring torus form. In an embodiment, the entire device 100 is manufactured by the same material. In an embodiment, the entire device 100 is manufactured by injection molding. In an embodiment, the entire device 100 is manufactured by attaching elements identified herein to each other in any method available to one having ordinary skill in the art at the time of the invention having the benefit of the description.

FIG. 11 illustrates a lateral cross sectional view 1100 of embodiments of an internal end portion 1002 of FIG. 10. In an embodiment, an internal end portion 1002 has a surface area 1102 with a portion of the surface area orthogonal to the longitudinal axis 40 of the device 100. In an embodiment, the surface area 1102 can remain in a plane orthogonal to the longitudinal axis 40 of the device 100. In an embodiment, the surface area 1102 can start from being in a plane orthogonal to the longitudinal axis 40 of the device 100 and being in a plane orthogonal to the longitudinally extending second portion 130, and can continue its surface area to curve toward or away from the extending second portion 130. In an embodiment the surface area 1002 can have a circular shape or a semi-hemisphere shape as illustrated in FIGS. 10 and 11.

FIG. 10 also illustrates an alternative embodiment wherein the internal end portion 1002 includes a reinforcement portion 1030, which is indicated in dashed lines. The reinforcement portion 1030 can be a single linear portion running from a spherical structure 608, 610 attached to its respective end or can a single linear portion running across two ends of a toric joint 1012 or can be a surface area connecting across the inside circumferential edge of the toric joint 1012. In an embodiment, a reinforcement portion 1030 can be added to any other embodiment of internal retainer end 132 or external retainer end 122.

FIG. 12 illustrates a close-up view of the embodiment of the balloon containment device including an embodiment of means for plugging a balloon. In an embodiment, central portion 102 has a sphere shape. FIGS. 13-22 illustrate longitudinal cross sectional view of different embodiments of an internal retainer end 132 or external retainer end 122 or a means for plugging a balloon. FIGS. 13-15 illustrate an embodiment of the central portion 102 having a three-dimensional egg shape.

FIG. 13 illustrates an embodiment of the central portion 102 having a mesh layer 1302. In an embodiment, a means for plugging a balloon can have a mesh layer. In an embodiment, a mesh layer 1302 can have small hemispherical bumps. In an embodiment, a mesh layer 1302 can have any shape as is known by one skilled in the art at the time of invention, having the benefit of the description herein. In an embodiment, a mesh layer 1302 can have a spiraling pattern. In an embodiment, a mesh layer 1302 can have sticky portions evenly distributed about the entire surface. In an embodiment, a mesh layer 1302 can have sticky portions evenly distributed about a portion of the surface about its diameter 104. In an embodiment, a mesh layer 1302 can have a sticky portion distributed about a portion of the surface about its diameter 104.

In an embodiment a mesh layer can be manufactured into or applied to any one or more of: a means for plugging a balloon, a means for maintaining a portion of the device outside the balloon, or a means for maintaining a portion of the device inside the balloon, as described herein.

FIG. 14 illustrates an embodiment of the central portion 102 having a longitudinally oblong shape. FIG. 15 illustrates an embodiment of the central portion 102 having a longitudinally oblong shape with a larger flattened diameter region. FIG. 16 illustrates an embodiment of the central portion 102 having a longitudinally oblong bullet shape. FIG. 17 illustrates an embodiment of the central portion 102 having a longitudinally directed cut off cone shape. FIG. 18 illustrates an embodiment of the central portion 102 having a longitudinally directed dual cone shape. FIG. 19 illustrates an embodiment of the central portion 102 having a longitudinally directed teardrop shape. FIG. 20 illustrates an embodiment of the central portion 102 having a longitudinally directed dual cone shape having a larger flattened diameter region and rounded corners at both its distal and proximate ends. FIG. 20 illustrates an embodiment of the central portion 102 having a three-dimensional oblong dual cone shape 2000 with an extended diameter surface area extending along the longitudinal axis 40. FIG. 21 illustrates an embodiment of the central portion 102 having a longitudinally oblong shape including one or more ring shaped ridges 2102. FIG. 16 illustrates an embodiment of the central portion 102 having a longitudinally oblong bullet shape including one or more ring shaped ridges 2102.

FIGS. 1, 2, 3, and 10 illustrate embodiments of a means for plugging a balloon. FIGS. 1-12 illustrate embodiments of a means for maintaining a portion of the device outside the balloon. FIGS. 1-12 illustrate embodiments of a means for maintaining a portion of the device inside the balloon. FIGS. 1-12 illustrate embodiments of a means for retaining the portion of the device outside the balloon opening portion to partially stay outside the balloon. FIGS. 1-12 illustrate embodiments of a means for retaining the portion of the device to partially stay inside the balloon. FIGS. 1-12 illustrate embodiments of a means for coming in contact with the balloon without puncturing the balloon. FIGS. 12-22 illustrate embodiments of a means for plugging a balloon.

Figure 23:
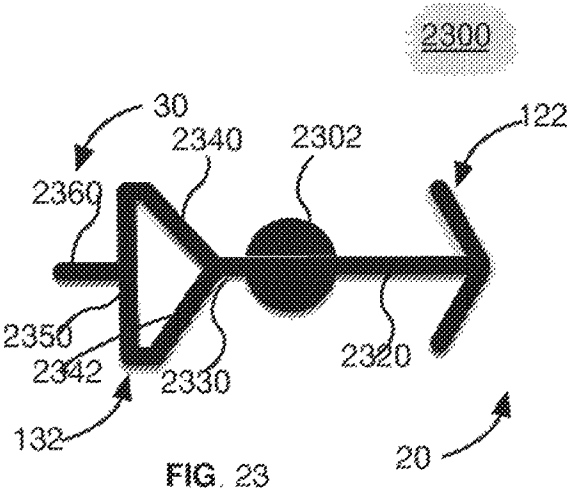
FIG. 23 illustrates a longitudinal cross sectional view of an embodiment of a balloon containment device as it is placed inside a balloon.

FIG. 23 illustrates a longitudinal cross sectional view of an embodiment of a balloon containment device. FIG. 23 illustrates a longitudinal cross sectional view of an embodiment of a balloon containment device including a means for maintaining a portion of the device outside the balloon and a means for maintaining a portion of the device inside of the balloon and a means for plugging a balloon. In an embodiment, a central portion 2302 has a sphere shape, which has a longitudinally extending first portion 2320 extending from it toward the proximate end 20 of a balloon opening. Central portion 2302 has a longitudinally extending second portion 2330 extending from the central portion 2302, and toward a distal end 30 from the balloon opening portion 110, and having a length designed for placement inside of the balloon 10. In an embodiment, longitudinally extending second portion 2330 includes an internal retainer end 132 for partial retainment of the device to stay inside a balloon. In an embodiment, internal retainer end 132 includes an internal end portion having an upper portion 2340 extending above a single plane containing the longitudinal axis 40 of the device 100, and a lower portion 2342 extending below the single plane containing the longitudinal axis 40 of the device. In an embodiment, the internal retainer end 132 includes a reinforcement portion 2350 connecting the upper portion 2340 and the lower portion 2342. In an embodiment, the internal retainer end 132 includes a reinforcement portion 2350 having an prolonged extension portion 2360. In an embodiment of the balloon containment device illustrated in FIG. 23, the internal retainer end 132 can be flipped in form, so that for example, the slanted portions 2340 and 2342 are more proximate 30 the interior of the balloon 10 when in position and the reinforcement portion 2350 is respectively more distal 20.

Figure 24:
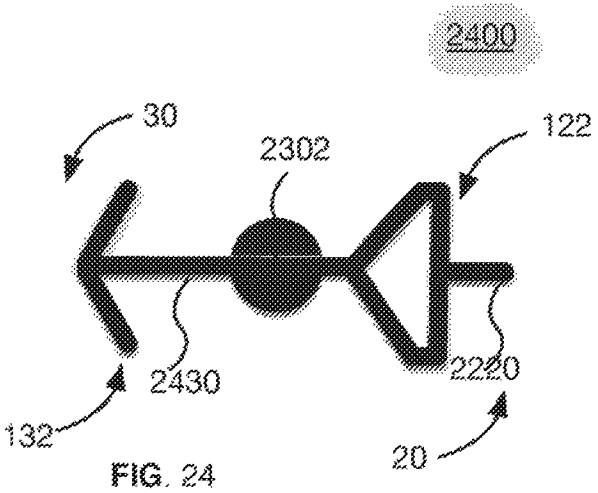
FIG. 24 illustrates a longitudinal cross sectional view of an embodiment of a balloon containment device as it is placed inside a balloon.

FIG. 24 illustrates a longitudinal cross sectional view of an embodiment of a balloon containment device similar to device 2300, except the element portions of the device 2400 are placed in reverse direction.

Figure 25:
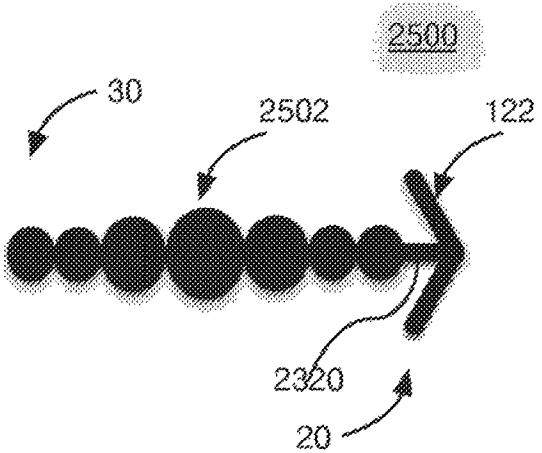
FIG. 25 illustrates a longitudinal cross sectional view of an embodiment of a balloon containment device as it is placed inside a balloon.

FIG. 25 illustrates a longitudinal cross sectional view of an embodiment of a balloon containment device as it is placed inside a balloon. FIG. 25 illustrates a longitudinal cross sectional view of an embodiment of a balloon containment device including a means for maintaining a portion of the device outside the balloon and a means for maintaining a portion of the device inside of the balloon and a means for plugging a balloon. In an embodiment, means for plugging a balloon 2502 includes a plurality of any combination of central portion shapes, such as any one or more of the shapes illustrated in FIGS. 12-22. In an embodiment, a means for plugging a balloon 2502 includes a plurality of sphere shaped central portions. In an embodiment, means for plugging a balloon 2502 includes a plurality of different sized sphere shaped central portions. In an embodiment, the device 2500 has the means for plugging a balloon also acting as a means for maintaining a portion of the device inside of the balloon or acting as a means for maintaining a portion of the device outside the balloon. For example, the largest sphere shaped form of a plurality of sphere shaped forms can be placed most proximate the interior of the balloon.

Figure 26:
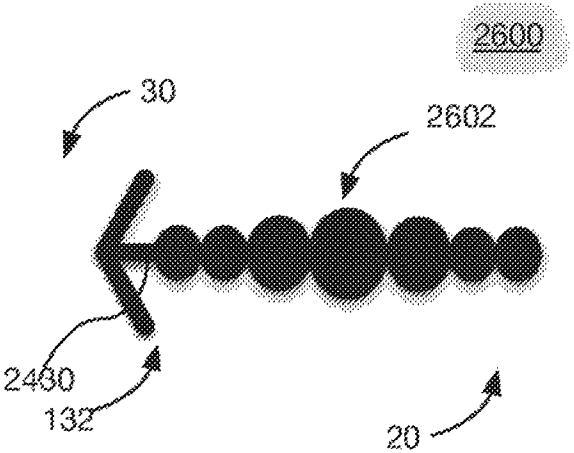
FIG. 26 illustrates a longitudinal cross sectional view of an embodiment of a balloon containment device as it is placed inside a balloon.

FIG. 26 illustrates a longitudinal cross sectional view of an embodiment of a balloon containment device similar to device 2500, except the element portions of the device 2600 are placed in reverse direction. In an embodiment, a means for plugging a balloon 2602 includes a plurality of any combination of central portion shapes, such as any one or more of the shapes illustrated in FIGS. 12-22.

Figure 27:
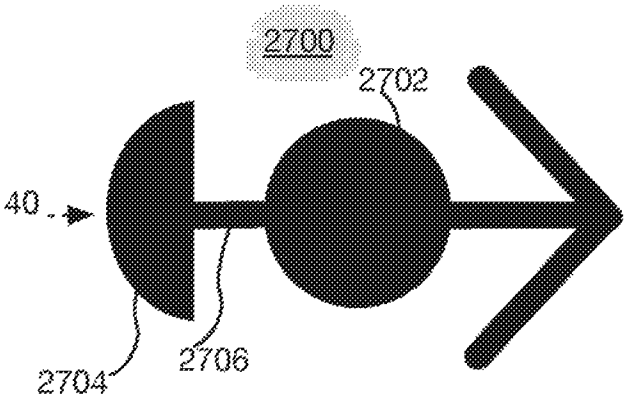
FIG. 27 illustrates a longitudinal cross sectional view of an embodiment of a balloon containment device as it is placed inside a balloon.

FIG. 27 illustrates a longitudinal cross sectional view of an embodiment of a balloon containment device. In an embodiment, a means for plugging a balloon consists of or includes a tacky spherical form 2702. In an embodiment, a means for maintaining a portion of the device inside the balloon consists of or includes a hemisphere form 2704 with an attachment to the means for plugging a balloon. In an embodiment, the attachment can be a linear tubular connector 2706. In an embodiment, a means for maintaining a portion of the device outside the balloon can be an arrow shaped end or an open-umbrella shaped end or a cone-shaped end.

Figure 28:
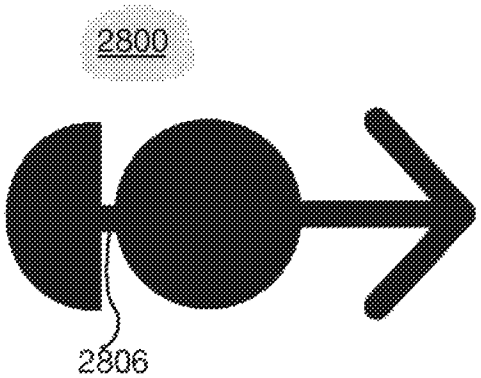
FIG. 28 illustrates a longitudinal cross sectional view of an embodiment of a balloon containment device.

FIG. 28 illustrates a longitudinal cross sectional view of an embodiment of a balloon containment device similar to the device illustrated in FIG. 27 except it has a shorter length attachment 2806 between the means for maintaining a portion of the device inside the balloon, and the means for plugging a balloon. In an embodiment, the means for maintaining a portion of the device inside the balloon can be directly attached, with no differing shape in between, to the means for plugging a balloon.

Figure 29:
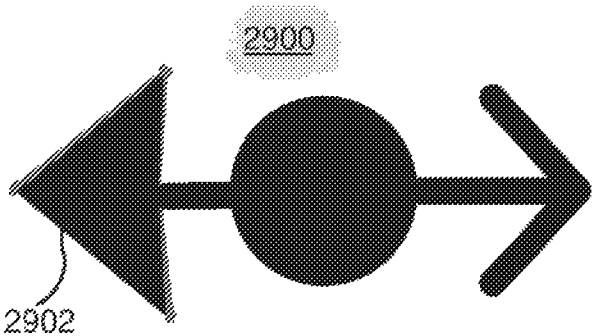
FIG. 29 illustrates a longitudinal cross sectional view of an embodiment of a balloon containment device.

FIG. 29 illustrates a longitudinal cross sectional view of an embodiment of a balloon containment device. In an embodiment, a means for maintaining a portion of the device inside the balloon consists of or includes a cone shaped form 2902. In an embodiment, a cone shape is three-dimensional.

Figure 30:
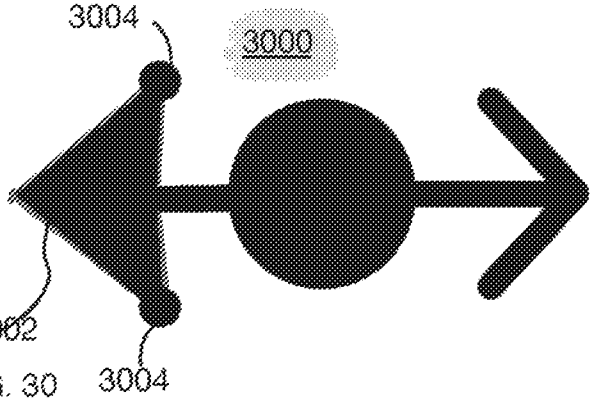
FIG. 30 illustrates a longitudinal cross sectional view of an embodiment of a balloon containment device.

FIG. 30 illustrates a longitudinal cross sectional view of an embodiment of a balloon containment device. In an embodiment, a means for maintaining a portion of the device inside the balloon consists of or includes a cone shaped form 3002 having a ring torus form 3004 at its largest circumference. In an embodiment, a means for not puncturing the balloon includes the toric section or a curved edge directed toward the closest balloon interior to prevent the balloon from puncture by the means for maintaining a portion of the device inside the balloon.

FIGS. 1-30 illustrate embodiments of at least one of a means for plugging a balloon or a means for maintaining a portion of the device outside the balloon or a means for maintaining a portion of the device inside the balloon. In an embodiment, an individual means for plugging a balloon can be combined with a means for maintaining a portion of the device inside the balloon and with a means for maintaining a portion of the device outside the balloon to form an embodiment of a balloon containment device.

One goal of the present invention is to provide a means for containing liquid, air, or gas within the inflatable boundary of an inflatable device such as an inflatable balloon in a manner that prevents or constrains an air containment mechanism installed therein from undesired displacement within the inflation boundary of the inflatable device. The inventor provides a means for constraining an air containment mechanism within the inflatable boundary of an inflatable device and a method for inflating such that the mechanism remains positionally viable in the function of obfuscating tie-off of the inflatable device once inflated. The present invention is described in enabling detail using the following examples, which may describe more than one relevant embodiment falling within the scope of the present invention.

Figure 31:
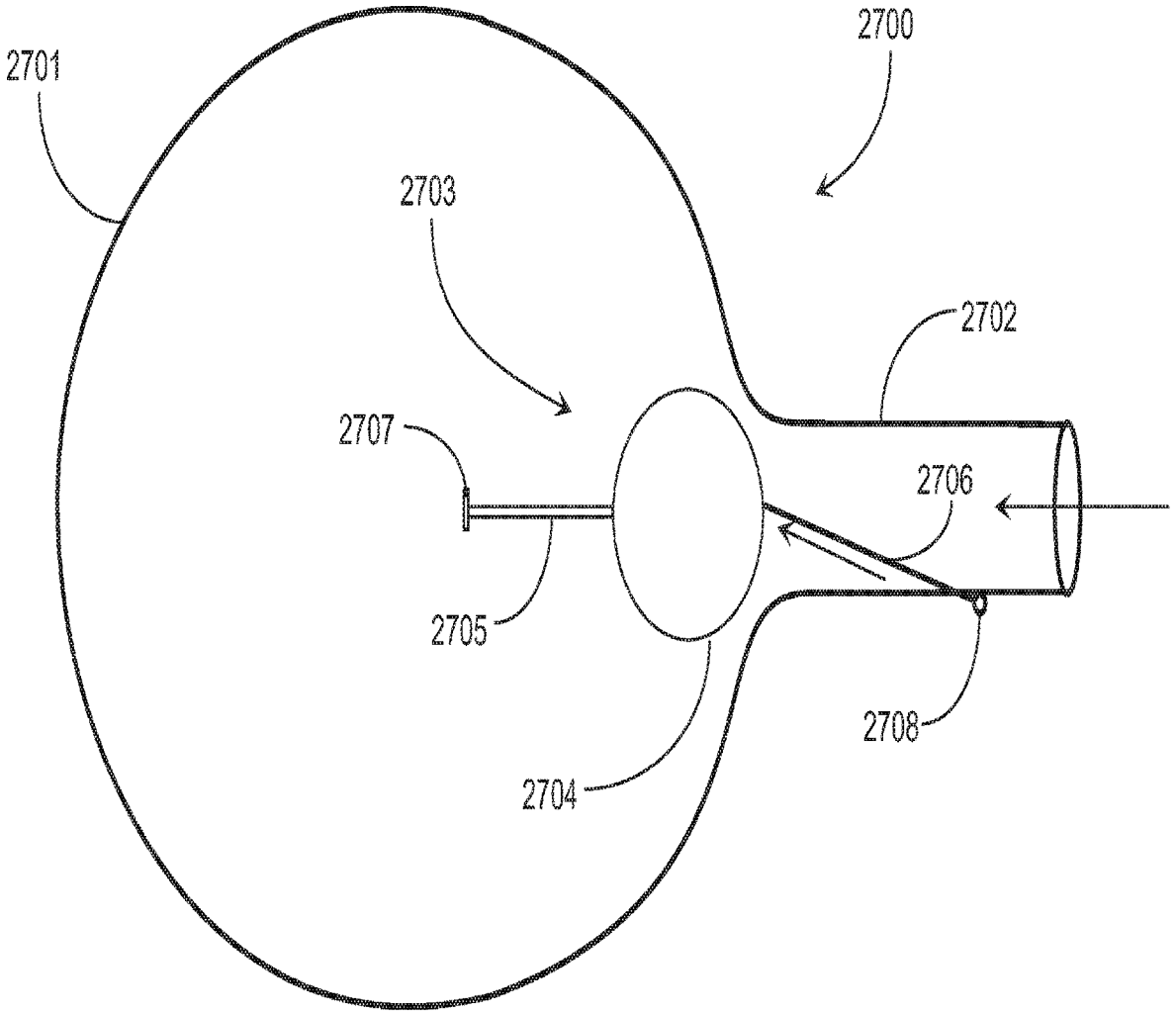
FIG. 31 is a longitudinal cross sectional view 2700 of an inflatable device 2701 with an air containment mechanism 2703 installed therein depicting inflation.

FIG. 31 is a cut view 2700 of an inflatable device 2701 with an air containment mechanism 2703 installed therein depicting inflation. Cut view 2700 depicts an inflatable device 2701 in the form of an elastic, inflatable balloon having a balloon neck portion 2702 culminating at an open end or proximal end of the balloon opposite a closed end or distal end of the balloon. Inflatable device 2701 may be one contiguous piece molded rubber or any other elastic or pliable synthetic materials that may be sewn together to form a device that may contain air or gas with little to no transfer of same through the device wall.

Air containment mechanism 2703 is depicted in an installed position within the inflatable boundary of device 2700, more particularly, within the balloon. In one embodiment, mechanism 2703 comprises at least one air containment body 2704. Air containment body 2704 may be a plastic-molded ball having an outside diameter (OD) significantly larger that the inside diameter (ID) of neck portion 2702 of inflatable device 2701. The outer surface of air containment body 2704 may be knurled, shaped, or roughed to provide a surface that will grip the inflated wall of inflatable device 2701. In one embodiment, air containment body 2704 is a solid object having a weight equal to the volume of plastic material used to create it. In another embodiment, air containment body 2704 is a hollow form that may be annular (ball) or may be formed of another annular or semi-annular shape such as a barrel, cylinder, cone, etc. Air containment object 2704 may be duplicated and used serially to provide two air containment objects connected together linearly wherein both objects have ODs exceeding the ID of neck portion 2702 of inflatable device 2701. Only one air containment object 2704 is depicted in this example however, FIGS. 25 and 26 of the specification above clearly depict more than a single air containment bodies arrayed serially and fixed together.

Air containment body 2704 includes a rearward facing (balloon orientation) elongated stem 2705 extending from the surface of air containment body 2704 longitudinally toward the distal end (closed end) of inflatable device 2701. Stem 2705 may be fabricated of a flexible plastic material and may be a thin flat plastic stem, a small diameter round plastic tube or rod. Rearward extending stem 2705 may be substantially straight or may be curved for additional safety. Rearward extending stem 2705 includes a retainment end 2707. Retainment end 2707 may be straight or curved in profile and may take any design shape without departing from the spirit and scope of the present invention. Additionally, end 2707 may have a notch or reduced dimension where it attaches to the body 2704. Rearward extending stem 2705 and retainment end 2707 provides a means to maintain air containment mechanism 2704 at least partly within the inflatable boundary of inflatable device 2701. Rearward extending stem 2705 and retainment end 2707 may be one contiguous piece that is attached to air containment body 2703. Air containment mechanism 2703 includes a forward facing (balloon orientation) control stem 2706 extending from the surface of air containment body 2704 longitudinally toward the proximal end (open end neck portion) of inflatable device 2701. Forward control stem 2706 may be fabricated of thin plastic material or of round plastic tubing or rod. Control stem 2706 may be substantially straight or may be curved for additional safety. Control stem 2706 can range from about 0.2 millimeters to about 3 millimeters in thickness, depending on the material used and the material and thickness of the balloon 10. The cross section of control stem 2706 can be a round or circular shape or can be a square shape to aid the stem in sliding back and forth when extended through neck portion 2702. A tube made of cloth or another light material may be pulled over the portion of control stem 2706 that extends through the wall of neck portion 2702 for additional safety and a cleaner look. Control stem 2706 includes a retainment end 2708. Retainment end 2708 may be a plastic ball, a plastic ring, a small piece of rubber or liquid latex, or some other form contiguous to control stem 2706 and formed on the end thereof. Control stem 2706 and retainment end 2708 provides a means to maintain air containment mechanism 2704 at least partly outside of the inflatable boundary of inflatable device 2701 during inflation of inflatable device 2701.

Figure 37:
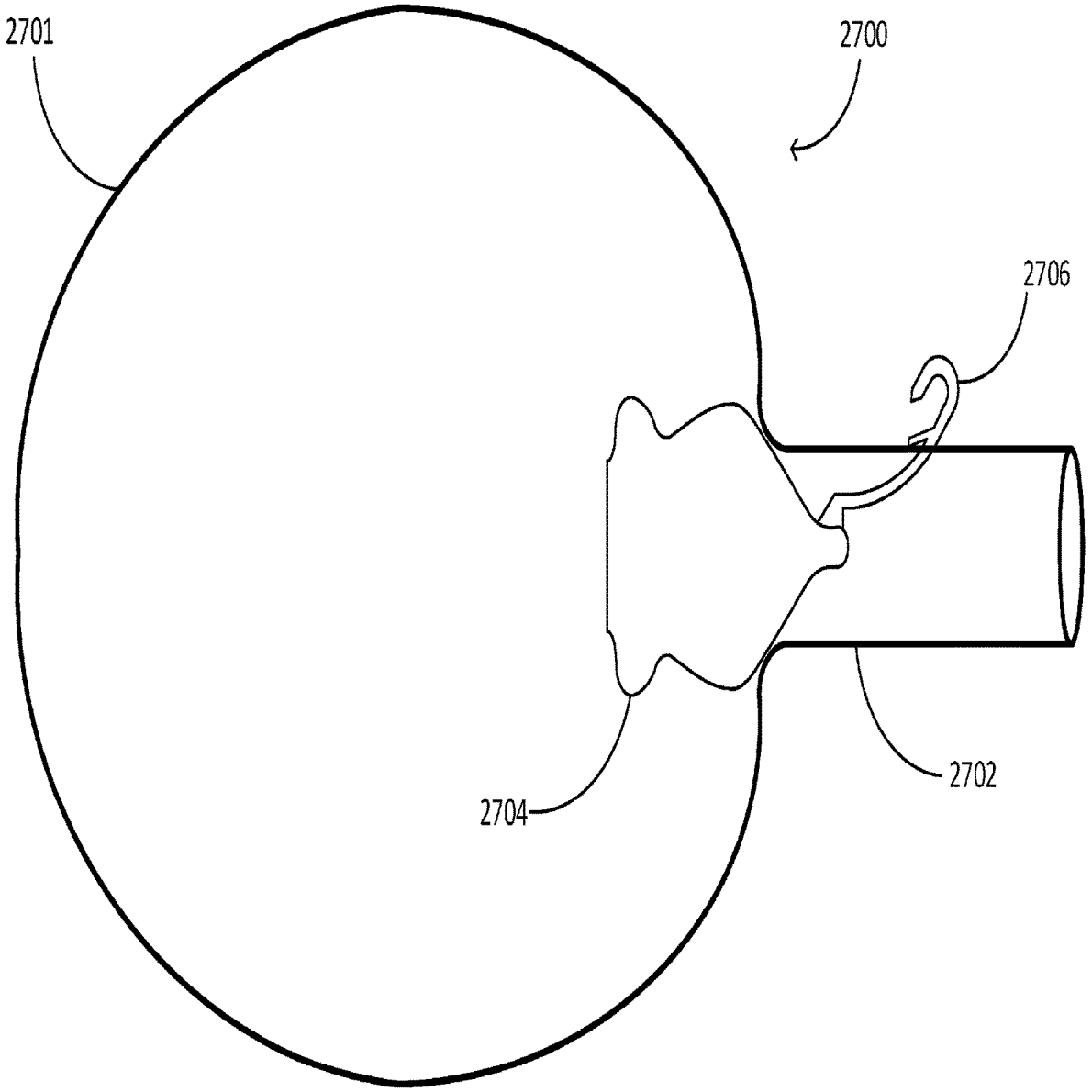
FIG. 37 is a cut view of a best mode embodiment of inflatable device 3101 with air containment mechanism 3103 installed therein.
Figure 38:
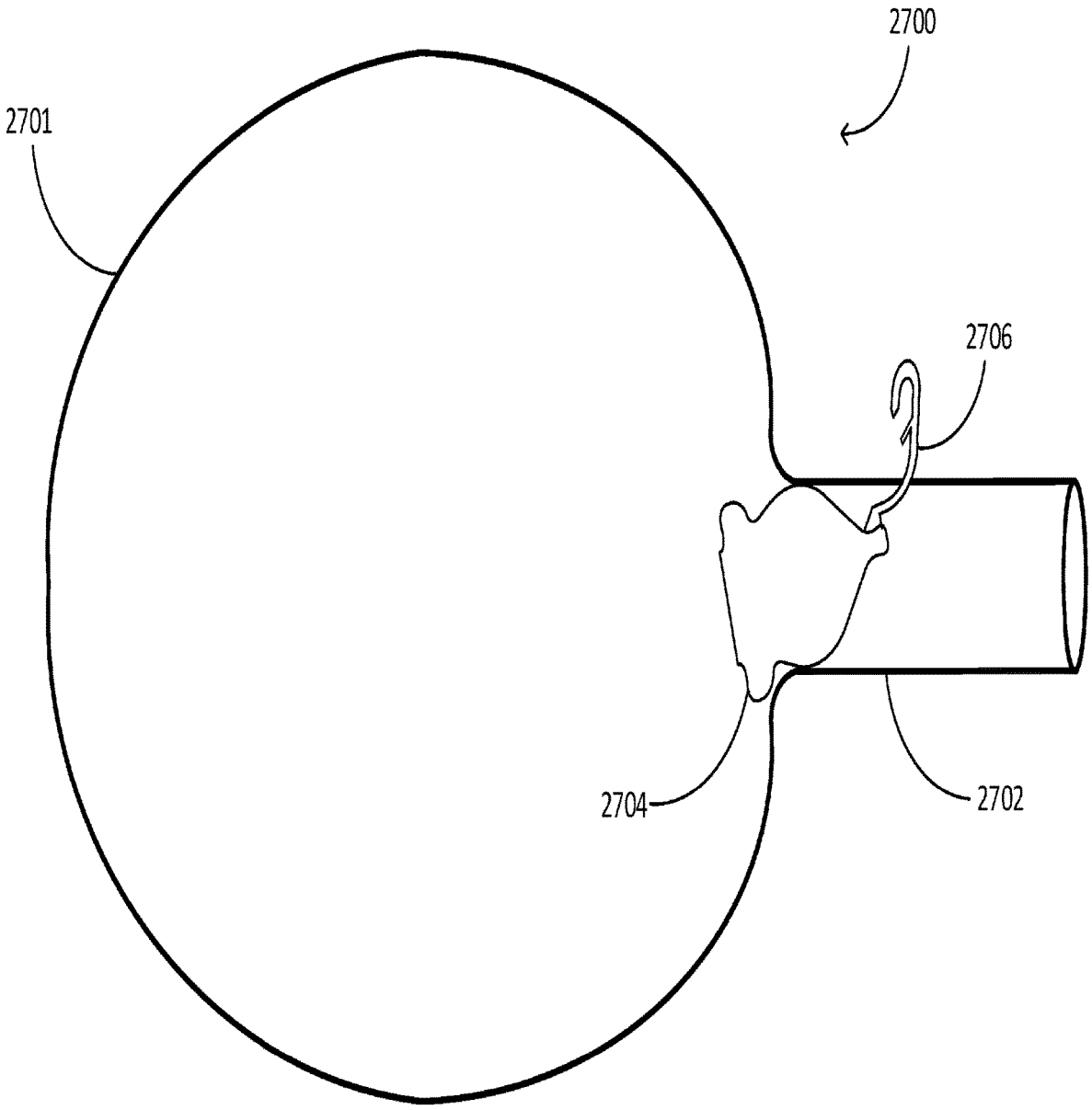
FIG. 38 is a cut view of a best mode embodiment of inflatable device 3101 with air containment mechanism 3103 installed therein depicting the position of air containment mechanism 3103 when inflatable device 3101 is inflated.

In a preferred embodiment, control stem 2706 extends through the wall of neck portion 2702 of inflatable device 2701 such that retainment end 2708 is positioned outside of the inflation boundary without breaching the proximal end (open end) of inflatable device 2701. This is depicted in FIG. 37. FIG. 38 depicts a preferred embodiment where air containment mechanism 2703 is positioned inside inflatable device 2701 in the preferred location when inflatable device 2701 is inflated. In one embodiment, air containment mechanism 2703 is molded into inflatable device 2701 such that control stem 2706 protrudes through a provided opening through the wall of the neck portion 2702. In one embodiment a user may install air containment mechanism 2703 within inflatable device 2701 using a provided tool to create an opening through which control stem 2706 and retainment end 2708 may be physically inserted before inflating the device. In one embodiment, stem openings are provided in the neck portions of stock inflatable devices.

Figure 39:
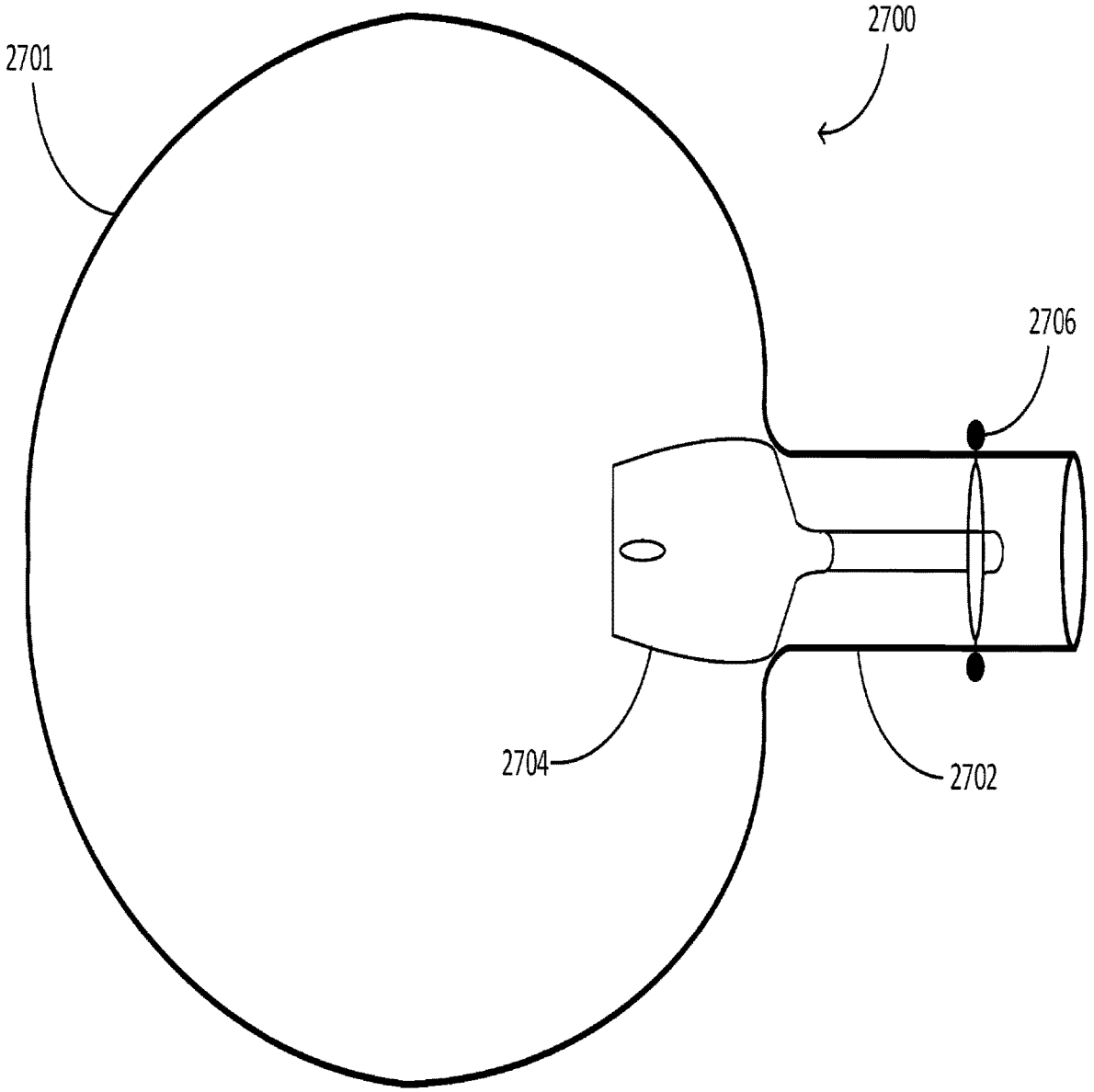
FIG. 39 is a cut view of an inflatable device 3101 with air containment mechanism 3103 installed therein depicting an alternate cross or "T" shape for the control stem 2706.

Control stem 2706 may also have a "T" or cross shape, where the perpendicular segments of the main stem portion both extend through the wall of neck portion 2702 of inflatable device 2701. This is depicted in FIG. 39.

Figure 36:
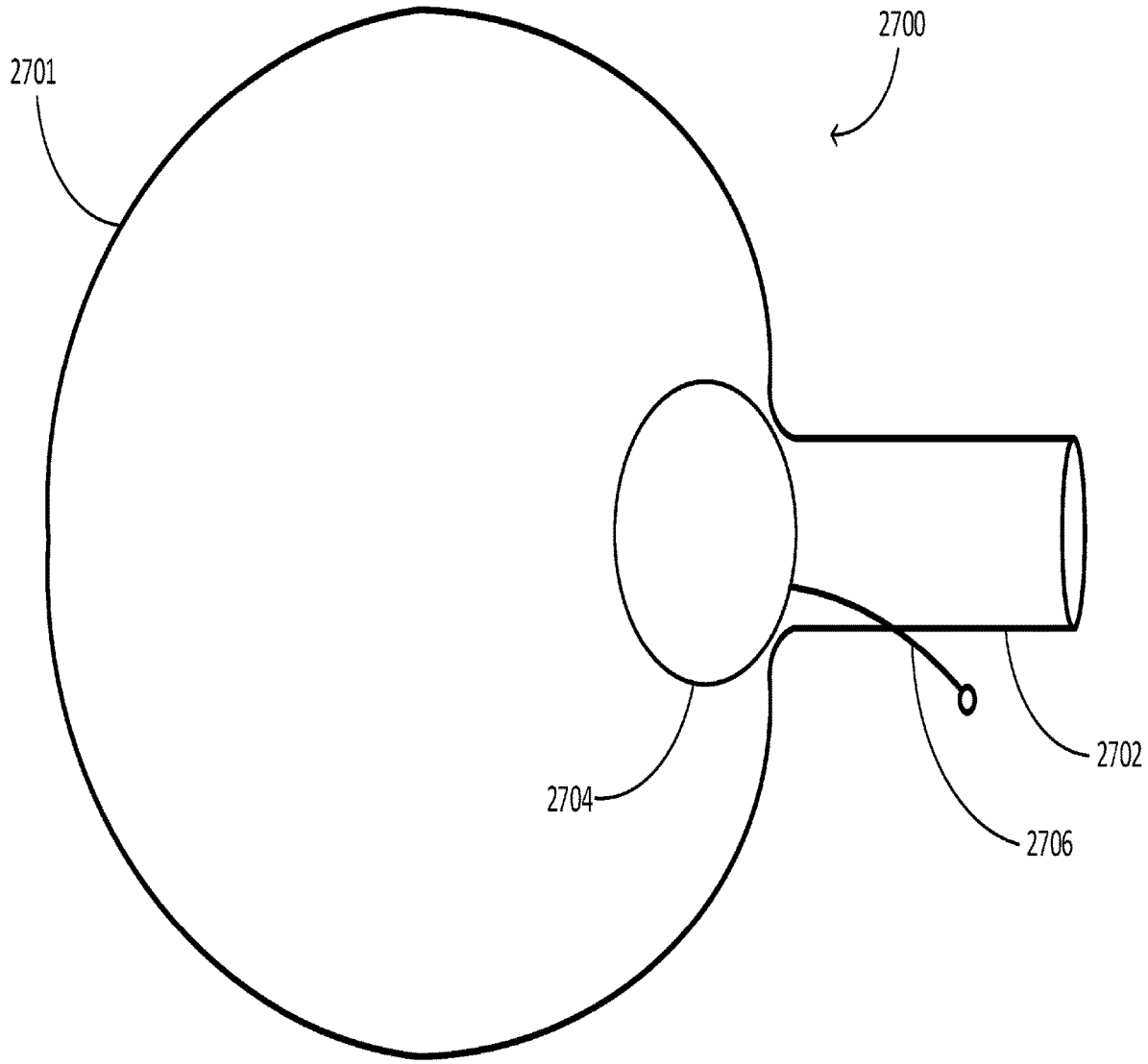
FIG. 36 is a cut view of an inflatable device 3101 with air containment mechanism 3103 installed therein depicting a curved control stem 2706 positioned off-center of the body 2704.

Control stem 2706 may also be connected to air containment mechanism 2704 at a location that is off-center when air containment mechanism 2704 is at the intended equilibrium position. In this configuration, the connection between control stem 2706 and air containment mechanism 2704 would not be located at the center of neck portion 2702. This prevents air containment mechanism 2704 from twisting during inflation and aids in ensuring that air containment mechanism 2704 remains in the same spot after inflation. This is depicted in FIG. 36.

Retainment end 2708 may be a ring, a solid or hollow form sphere or ball, a disc, an inverted cup shape, or some other moldable form. The OD of retainment end 2708 is significantly larger than the provided opening in neck portion 2702 requiring stretching of the material of inflatable device 2701 to expand the opening beyond the diameter of the retainment end enabling insertion thereof through said opening. The elastic retention property of the material functions to close the opening against the stem diameter once the retainment end is inserted through the opening. The immediate proximity of air containment body to the neck portion 2702 of inflatable device 2701 may be controlled by the constraint of length given to control stem 2706. The exact length may be determined by manufacturer based on design.

In this view, inflatable device 2701 is in a state of being inflated according to the direction of the directional arrow entering neck portion 2702. Air containment body 2704 is pushed toward the distal end of inflatable device 2701 by air coming in through neck portion 2702 of inflatable device 2701. Air containment body 2704 is set furthest toward the rear as allowed by control stem 2706 with retainment end 2708 abutting against the sidewall of neck portion 2702 of inflatable device 2701. In this embodiment, air pressure in displaces mechanism 2703 just enough the get air or gas in and around air containment body 2704.

Figure 32:
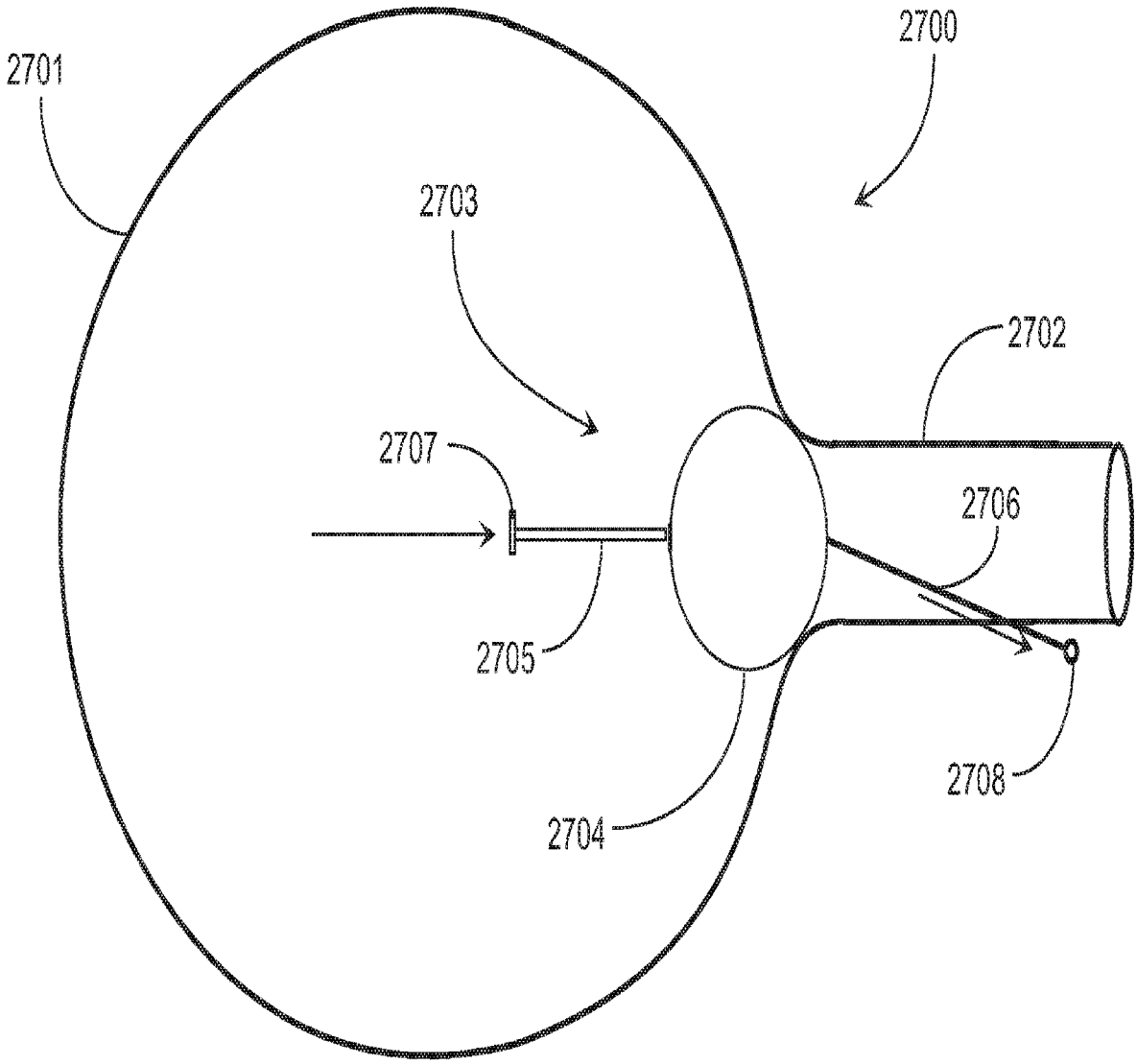
FIG. 32 is a longitudinal cross sectional view of inflatable device 2701 with air containment mechanism 2703 of FIG. 31 installed therein depicting air containment.

FIG. 32 is a cut view of inflatable device 2701 with air containment mechanism 2703 of FIG. 31 installed therein depicting air containment. In this view, air containment body 2704 is lodged forward against neck portion 2702 by the air pressure caused by a measure of inflation of the inflatable device. The direction of the directional arrow depicts air attempting to escape the inflatable boundary of the inflatable device 2701. Control stem 2706 has a small bi-directional travel range enabling the mechanism to travel forward to stop against the shoulder of neck portion 2702. At this stage, no air is allowed to pass out through neck portion 2702. In this embodiment, air pressure out forces air containment mechanism 2703 against the annular shoulder of neck portion 2702 with enough force to seal air containment body 2704 against the material of inflatable device 2701 at neck portion 2702 preventing leakage of air past the air containment body.

Figure 33:
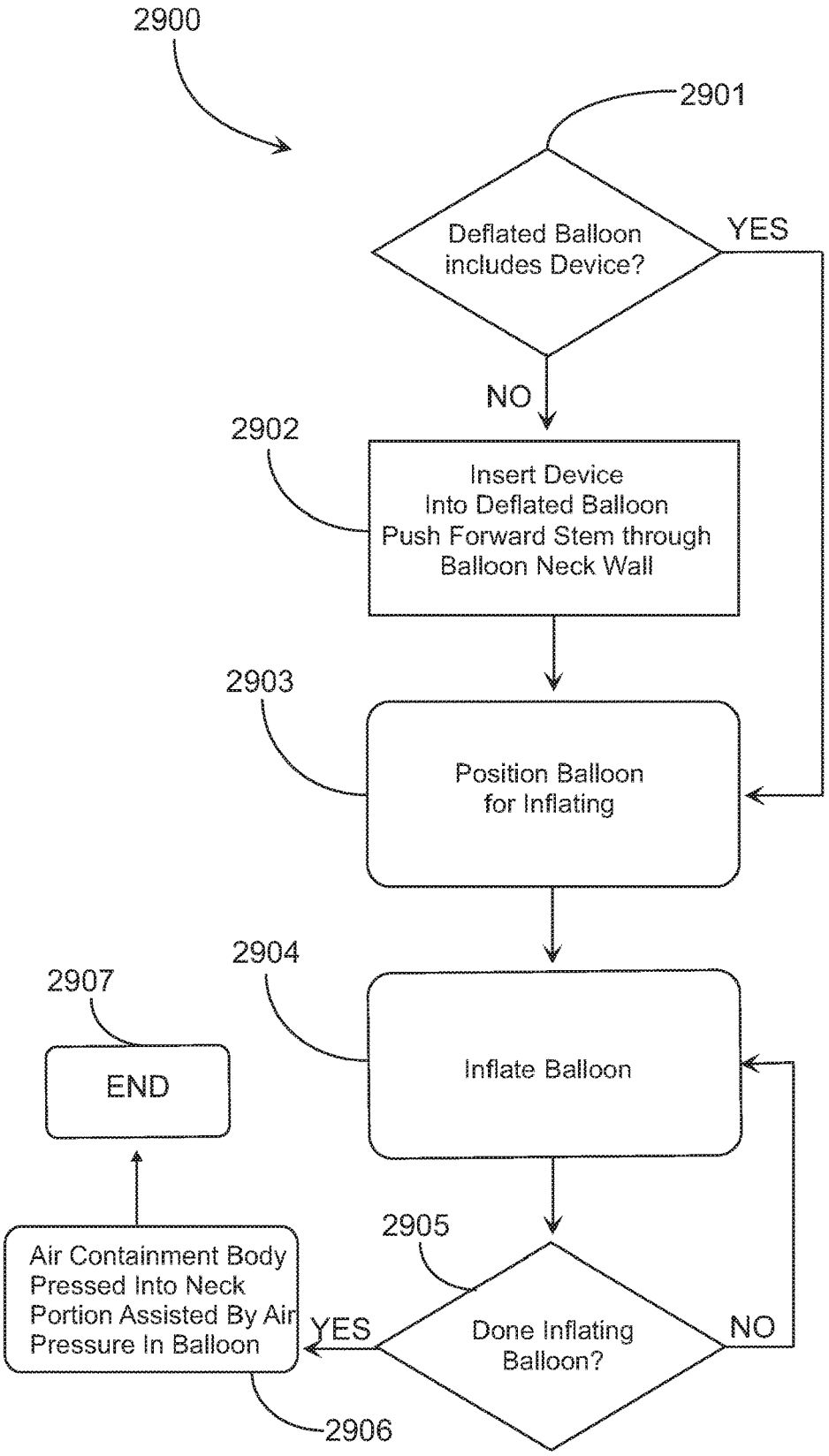
FIG. 33 is a process flow chart 2900 depicting steps for inflating the inflatable device with air containment mechanism of FIG. 31.

FIG. 33 is a process flow chart 2900 depicting steps for inflating the inflatable device with air containment mechanism of FIG. 31. A user may make a determination at step 2901 if an inflatable device such as a balloon for example has an air containment mechanism installed therein and ready for use. If the user finds that the inflatable device is not previously installed then the user may install the device into a deflated inflatable device at step 2902. This process may include inserting the air containment mechanism reward stem first into the inflatable device making sure that the air containment body is pushed past the neck portion of the inflatable device. The user may also insert the forward facing stem through an opening provided for the purpose in the neck portion of the inflatable device as part of this step.

If the user determines that the air containment mechanism is already installed correctly at step 2902, the process may skip to step 2903 where the user may position the inflatable device, in this case a balloon, for inflating. The step of positioning the balloon may depend upon the chosen means for inflating the balloon. At strep 2904 the user may inflate the inflatable device according to a selected means of inflation. For example, the user may select manual inflation by physically blowing the balloon up using breath. In that case positioning the inflatable device simply refers to holding it up to the user's mouth for inflating at step 2904. If the user has access to a pressurized tank of hydrogen or other gas to inflate the balloon with, the positioning may mean placing the balloon neck portion over a gas nozzle or inflation head or nipple to be inflated at step 2904 using a gas on/off valve to inflate the balloon.

Regardless of the inflation means selected for inflating said inflatable device, at 2905 the user may make a determination as to when the user may be finished inflating the inflatable device. During inflation using physical breath, the user may pause or stop inflating (blowing in) momentarily while holding the inflatable device. At each pause, the air containment body of the air containment mechanism automatically seats against the annular shoulder of the neck portion of the inflatable device due to the pressure (air travel toward opening) created by the expansion of the inflatable device during inflation. If the inflation means is a pressurized gas tank with a nozzle, the user may simply stop inflating when the inflatable device is of sufficient size and shape for display as a properly inflated device.

In one embodiment an inflatable device has more than one point of inflation and more than one cordoned area to be inflated, An example of this may be a balloon animal created from more than one balloon tied together. In such an embodiment, there may be an air containment mechanism for each inflatable portion of the inflatable device. If at step 2905, the user determines they are not finished inflating the inflatable device or balloon in this case, the process may resolve back to step 2904 continued inflating. If the user is finished inflating the inflatable device at step 2905, the process may end at step 2906 without requiring any action by the user such as tying off. Rather, the air containment mechanism functions to prevent air or gas from escaping through the neck portion of the inflatable device by virtue of lodge of the air containment body into the annular shoulder of the neck portion of the inflatable device.

Figure 34A:
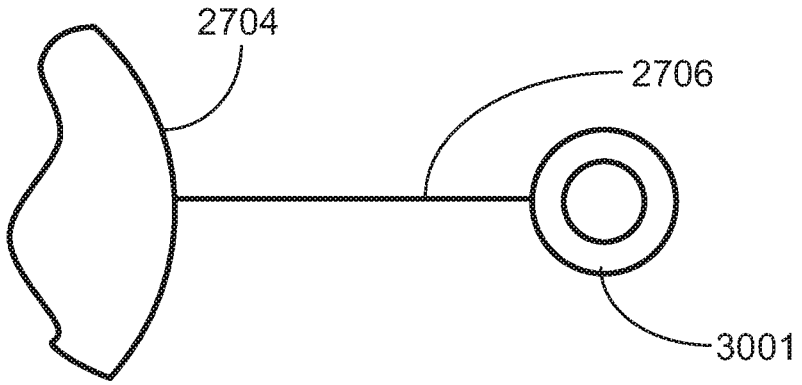
FIG. 34A is an exploded view of a forward-extending stem having an annular hollow stem anchor.

Referring now to FIG. 34A, control stem 2706 includes a retainment end 3001 in the form of a ring or hollow form barrel shape. Element 2704 represents a partial view of the air containment body of the same element number (see FIG. 31). The position of attachment of the stem to body 2704 may be centered with reference to the air containment body or off center to inhibit spin or rotation of the air containment body 2704.

Figure 34B:
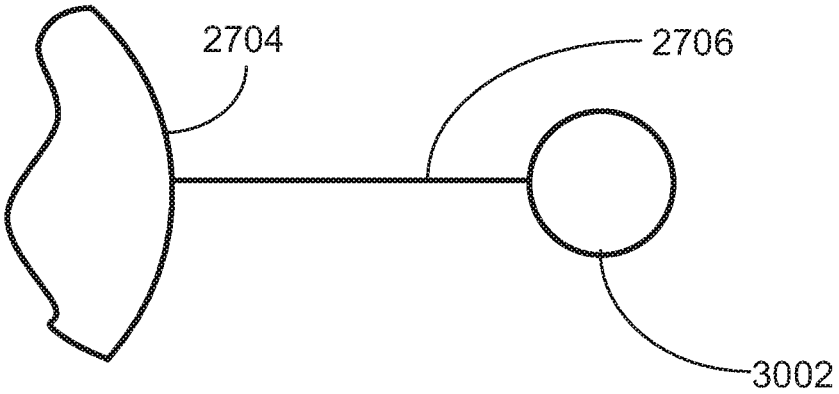
FIG. 34B is an exploded view of a forward-extending stem having a solid annular stem anchor.
Figure 34C:
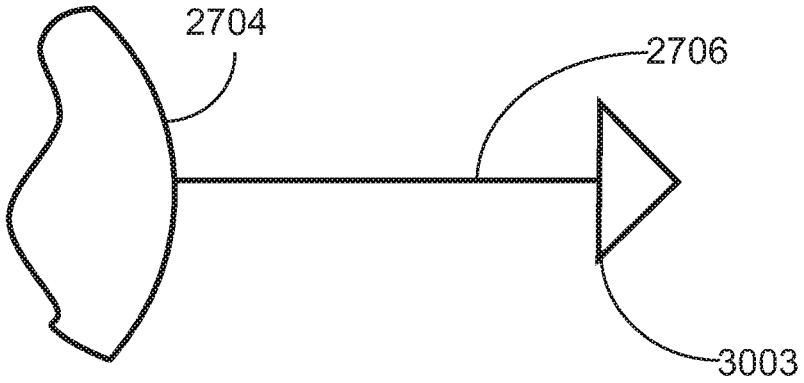
FIG. 34C is an exploded view of a forward-extending stem having a solid conical stem anchor.

Referring now to FIG. 34B, control stem 2706 includes a retainment end 3002 in the form of a solid annular (ball) shape. Element 2704 represents a partial view of the air containment body of the same element number (see FIG. 31). The position of attachment of the stem to body 2704 may be centered with reference to the air containment body or off center to inhibit spin or rotation of the air containment body 2704. Referring now to FIG. 30C, control stem 2706 includes a retainment end 3002 in the form of a conical shape. Element 2704 represents a partial view of the air containment body of the same element number (see FIG. 31). The position of attachment of the stem to body 2704 may be centered with reference to the air containment body or off center to inhibit spin or rotation of the air containment body 2704.

In these three examples, the retainment end is significantly larger in diameter than the stem body and larger than the opening provided in the neck portion of the inflatable device for the stem and retainment end to pass through. It should be noted herein that the selection of an end form for retainment ends 3001-3003 shall not be limited as any desired shape may be incorporated without departing from the spirit and scope of the present invention. It is further noted herein that the movement of the forward facing stem body through the opening provided in the neck portion of the inflatable device may be controlled for each implementation by the length of the stem body and the linear position of the opening in the neck portion of the inflatable device. Actual dimensions and tolerances of the air containment mechanism may be engineered by the manufacturer, which may depend at least in part on the physical size and shape of the inflatable device.

Figure 35:
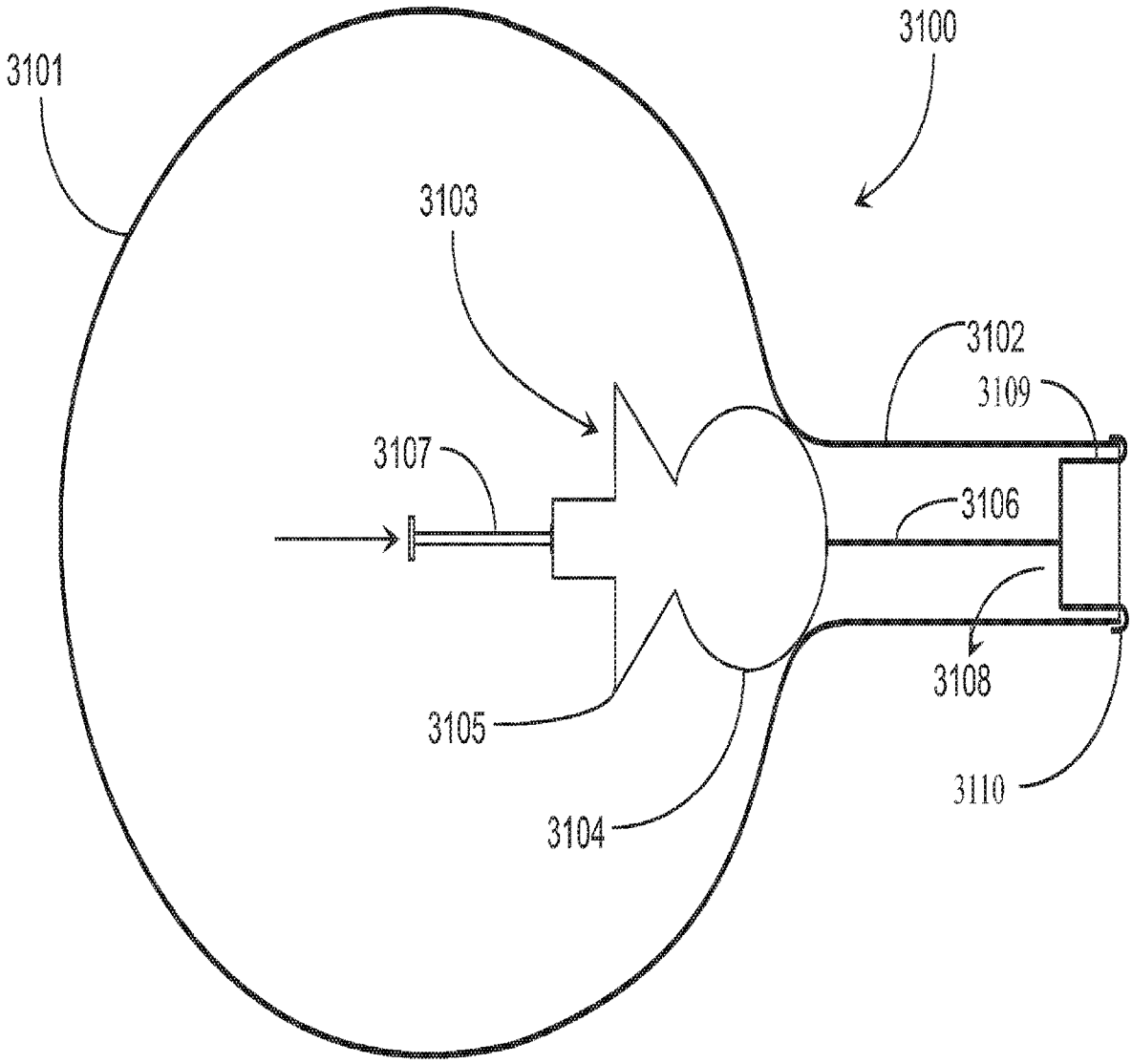
FIG. 35 is a cut view of an inflatable device 3101 with air containment mechanism 3103 installed therein depicting air containment.

FIG. 35 is a cut view of an inflatable device 3101 with air containment mechanism 3103 installed therein depicting air containment. Assembly balloon/stop assembly 3100 includes an inflatable device 3101 analogous to device 2701 of FIG. 31 and an air containment mechanism 3103. Inflatable device 3101 includes a neck portion 3102 culminating at an open end.

In this embodiment, air containment body 3103 has a forward annular portion 3104 purposed to block air escaping through neck portion 3102 much like body 2704 introduced in the description above relative to FIG. 31. Air containment body 3103 further includes a means for blocking off escaping air should the annular portion 3104 of body 3103 advance into the neck portion 3102 and may be at risk of being expelled from the inflatable device. This means may be effected by a conical portion 3104 of air containment body 3103 formed substantially at true position just behind annular portion 3104 as a contiguous portion of the body.

The outside diameter (OD) of conical body portion 3105 is larger than the OD of annular portion 3104. This engineered feature prevents the air containment mechanism 3103 from escaping the inflatable device. A retainment mechanism 3107 (for orientation, positioning and balance) may be analogous to stem 2705 and retainment end 2707 of FIG. 31. Air containment body 3103 includes a forward elongated stem 3106 attached substantially centered with annular portion 3104 of mechanism 3103. A retainment end 3108 is fixed or contiguously part of the stem and is situated at the free end of the stem.

Retainment end includes a cross bar portion having an outside to outside dimension just smaller than the deflated inside diameter of neck portion 3102 of inflatable device 3101. A pair of arm portions 3109 and 3110 formed orthogonally forward to the cross bar portion are disposed at the free ends of the cross bar portion wherein each arm portion includes an outward facing hook formed at the forward end thereof. In this embodiment, a user may hook arms 3109 and 3110 over the rim of the opening in neck portion 3102 of inflatable device 3101 thus providing one means of preventing the air containment mechanism 3103 from escaping further into the inflatable device when it is in the state of being inflated.

It will be apparent to one with skill in the art that the inflatable device air containment system of the invention may be provided using some or all of the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

The invention claimed is:

1. An inflatable device comprising:

an inflatable balloon having a body and a neck portion, the neck portion formed by a sidewall having a proximal end opposite the body and a distal end adjacent the body, the sidewall forming a balloon opening portion having an inner dimension when the balloon is inflated, wherein the proximal end of the neck portion comprises a first opening for a flow of a fluid into and out of the inflatable balloon;

an air containment body positioned in the body, the air containment body having a first outer dimension larger than an inner dimension of the balloon opening portion and positionable relative to the distal end of the neck portion; and, an elongate external retainer extending from the air containment body through a second opening formed in the sidewall of the neck portion, the elongate external retainer having a retainment end positioned outside the balloon, wherein the second opening in the sidewall of the neck portion is located within a middle portion of the neck portion, and wherein the second opening is closed against the elongate external retainer by an elastic retention property of the inflatable balloon.

2. The inflatable device of claim 1, wherein the elongate external retainer comprises a flexible plastic material.

3. The inflatable device of claim 1, wherein the elongate external retainer comprises a square cross-sectional shape in the region where the elongated external retainer extends through the opening in the sidewall of the neck portion.

4. The inflatable device of claim 1, wherein at least a portion of the air containment body facing the neck portion is knurled, roughed, or sticky.

5. The inflatable device of claim 1, wherein the air containment body comprises a longitudinal axis, and the elongate external retainer bends away from the longitudinal axis beyond the first outer dimension of the air containment body.

6. The inflatable device of claim 1, wherein the retainment end of the elongate external retainer comprises a barb.

7. The inflatable device of claim 1, wherein the air containment body comprises a longitudinal axis, and the elongate external retainer is attached to a surface of the air containment body at a location offset from the longitudinal axis.

8. The inflatable device of claim 1, wherein the air containment body comprises a distal portion opposite the neck portion of the balloon, the distal portion having a second outer dimension larger than the first outer dimension.

9. The inflatable device of claim 8, wherein the air containment body further comprises a third outer dimension separating the first outer dimension and the second outer dimension, the third outer dimension being smaller than the first outer dimension and the second outer dimension.

10. An inflatable device comprising:

an inflatable balloon having a body and a neck portion, the neck portion formed by a sidewall having a proximal end opposite the body and a distal end adjacent the body, the sidewall forming a balloon opening portion having an inner diameter when the balloon is inflated, wherein the proximal end of the neck portion comprises a first opening for a flow of a fluid into and out of the inflatable balloon;

an air containment body positioned in the body, the air containment body having a rounded surface facing the neck portion, the rounded surface having a first outer diameter larger than an inner diameter of the balloon opening portion and positionable relative to the distal end of the neck portion; and, a flexible elongate external retainer curving from the air containment body through a second opening formed in the sidewall of the neck portion, the elongate external retainer having a retainment end positioned outside the balloon, wherein the second opening in the sidewall of the neck portion is located within a middle portion of the neck portion, and wherein the second opening is closed against the elongate external retainer by an elastic retention property of the inflatable balloon.

11. The inflatable device of claim 10, wherein the elongate external retainer comprises a plastic material.

12. The inflatable device of claim 10, wherein the elongate external retainer comprises a square cross-sectional shape in the region where the elongated external retainer extends through the opening in the sidewall of the neck portion.

13. The inflatable device of claim 10, wherein at least a portion of the air containment body facing the neck portion is knurled, roughed, or sticky.

14. The inflatable device of claim 10, wherein the air containment body comprises a longitudinal axis, and the elongate external retainer curves away from the longitudinal axis beyond the outer diameter of the air containment body.

15. The inflatable device of claim 10, wherein the retainment end of the elongate external retainer comprises a barb.

16. The inflatable device of claim 10, wherein the air containment body comprises a longitudinal axis, and the elongate external retainer is attached to a surface of the air containment body at a location offset from the longitudinal axis.

17. The inflatable device of claim 10, wherein the air containment body comprises a distal portion opposite the neck portion of the balloon, the distal portion having a second outer diameter larger than the first outer diameter.

18. The inflatable device of claim 17, wherein the air containment body further comprises a third outer diameter separating the first outer diameter and the second outer diameter, the third outer diameter being smaller than the first outer diameter and the second outer diameter.

19. A method comprising:

providing an inflatable balloon having a body and a neck portion, the neck portion formed by a sidewall having a proximal end opposite the body and a distal end adjacent the body, the sidewall forming a balloon opening portion having an inner dimension when the balloon is inflated, wherein the proximal end of the neck portion comprises a first opening for a flow of a fluid into and out of the inflatable balloon;

positioning an air containment body in the body of the balloon, the air containment body having an outer dimension larger than an inner dimension of the balloon opening portion; and, positioning an elongate external retainer connected to the air containment body through a second opening formed in the sidewall of the neck portion such that a retainment end of the elongate external retainer is positioned outside of the balloon, wherein the second opening in the sidewall of the neck portion is located within a middle portion of the neck portion, and wherein the second opening is closed against the elongate external retainer by an elastic retention property of the inflatable balloon.

20. The method of claim 19, further comprising:

positioning the air containment body at a distance relative to the distal end of the neck portion of the balloon;

delivering air into the balloon through the opening portion; and, repositioning the air containment body against the distal end of the neck portion of the balloon.

* * * * *